United States Patent [19]

Arold et al.

[11] Patent Number: 4,712,608

[45] Date of Patent: Dec. 15, 1987

[54] HEAT EXCHANGER FOR THE INDEPENDENT HEATING OF THE DRIVER AND FRONT-SEAT PASSENGER SIDE OF A MOTOR VEHICLE

[75] Inventors: Klaus Arold, Sindelfingen, Fed. Rep. of Germany; Hermann Grimm, deceased, late of Ostelsheim, Fed. Rep. of Germany, by Christel Grimm, executrix; Heinz Koukal, Sindelfingen, Fed. Rep. of Germany

[73] Assignee: Daimler-Benz Aktiengesellschaft, Stuttgart, Fed. Rep. of Germany

[21] Appl. No.: 827,287

[22] Filed: Feb. 7, 1986

[30] Foreign Application Priority Data

Feb. 7, 1985 [DE] Fed. Rep. of Germany ..... 3504129

[51] Int. Cl.[4] ..... F28F 1/10; F28D 7/00

[52] U.S. Cl. ..... 165/41; 165/144; 165/151; 165/176; 237/12.3 B

[58] Field of Search ..... 165/41, 174, 176, 144, 165/151; 237/12.3 B

[56] References Cited

U.S. PATENT DOCUMENTS

| | | | |
|---|---|---|---|
| 2,044,455 | 6/1936 | Witzel | 165/174 |
| 3,067,818 | 12/1962 | Ware et al. | 165/174 |
| 3,173,482 | 3/1965 | Allender | 165/174 |
| 3,478,821 | 11/1969 | Fieni | 165/151 |
| 3,516,483 | 6/1970 | Benteler et al. | 165/174 |
| 4,485,867 | 12/1984 | Melnyk et al. | 165/176 |
| 4,559,994 | 12/1985 | Waldmann et al. | 165/41 |

FOREIGN PATENT DOCUMENTS

| | | | |
|---|---|---|---|
| 2304832 | 8/1974 | Fed. Rep. of Germany | 165/144 |
| 7836166 | 7/1983 | France . | |
| 573227 | 2/1958 | Italy | 165/174 |
| 0028476 | 2/1980 | Japan | 165/176 |
| 20853 | of 1902 | United Kingdom | 165/176 |
| 844660 | 8/1960 | United Kingdom | 165/176 |

*Primary Examiner*—Albert W. Davis, Jr.
*Assistant Examiner*—John K. Ford
*Attorney, Agent, or Firm*—Barnes & Thornburg

[57] ABSTRACT

A heat exchanger for the independent heating of the driver and front-seat passenger side of a passenger space, having flow pipes located at the ends of the heat exchanger at the transition between the upper and lower water compartment. These flow pipes are connected to the central flow connection via a flow channel transverse to the central flow connection and corresponding juncture channel. The transverse channel is located above a collecting chamber which is located at the lower side of the upper water compartment. The flow pipes guide the flow from the upper water compartment to the lower water compartment. Return pipes are positioned to guide the flow from the lower water compartment into the collecting chamber in the upper water compartment. From the collecting chamber the flow travels out of the upper water compartment through return connections.

26 Claims, 8 Drawing Figures

HEAT EXCHANGER FOR THE INDEPENDENT HEATING OF THE DRIVER AND FRONT-SEAT PASSENGER SIDE OF A MOTOR VEHICLE

BACKGROUND AND SUMMARY OF THE INVENTION

The invention relates to a heat exchanger for the independent heating of the driver and front-seat passenger sides of a motor vehicle. The heat exchanger has two ribbed pipe blocks which are separated from one another but are assigned to a common upper and lower water compartment. A heating medium, in particular engine cooling water and air, flows through each of the ribbed pipe blocks. The ribbed pipe blocks each comprise several parallel pipes and ribs at right angles to the pipes, having flow and return connections which are positioned at a longitudinal side of the upper water compartment. The two return connections of the ribbed pipe blocks are located on either side of a central flow connection. Each return connection is connected to a collecting chamber which is positioned at the lower portion of the upper water compartment.

One problem with the known art is that the best exchanger is designed in such a way that the flow is guided centrally through the ribbed pipe blocks and then returned through pipes positioned on the outermost ends of the ribbed pipe blocks. This can result in disadvantages in the thermal stratification, in particular when using a heat exchanger of this type for automatically controlled heating or air-conditioning installations.

It is an object of the invention to alleviate this disadvantage while retaining the construction of essential parts of the heat exchanger, in particular the ribbed pipe blocks.

This objective is achieved according to the invention in that pipes located in the area of the ends of the heat exchanger are provided as flow pipes, and that the flow connection is connected to the flow pipes via a transverse channel which is located above the collecting chamber into which the return pipes open.

By means of this arrangement, it is possible to operate a heat exchanger of the type mentioned above such that the flow is guided around the outermost ends of the heat exchanger, that is, to the right and left ends with respect to an upright heat exchanger, whereas the return flow is guided centrally through the intermediate area. In this way, the desired stratification for automatic operation is obtained, and can be effected without further substantial interference with the construction of the heat exchanger. Thus, at least with respect to the ribbed pipe blocks, heat exchangers of the same construction can be used for both the central guidance of flow (with return flow on the outermost ends of the heat exchanger) and the guidance of flow on the outermost ends of the heat exchanger (with a central return flow).

In preferred embodiments of the invention, the transverse channel is adjacent to a longitudinal side of the upper water compartment, which longitudinal side is opposite the longitudinal side having the central and return flow connections.

Moreover, a constructionally simple design is provided if the transverse channel is made as a channel which is open to at least one of the narrow sides of the heat exchanger and can be closed by an insert. Thus, the water compartment can also be advantageously made as a casting.

A further advantageous feature of the invention for a water compartment for a heat exchanger having a laterally outward directed flow is that the transverse channel, together with the flow connection, is formed by two shell halves. One shell half is formed into the upper side of the water compartment and the other shell halve is placed onto the upper side of the water compartment. Such an embodiment can be efficiently produced and has the further advantage of having good connection possibilities. In particular, good connections occur when the dividing plane of the two shell halves coincides with the center plane through the flow and return connections.

Other objects, advantages and novel features of the present invention will become apparent from the following detailed description of the invention when considered in conjunction with the accompanying drawings.

DETAILED DESCRIPTION OF THE DRAWINGS

Figure 2:
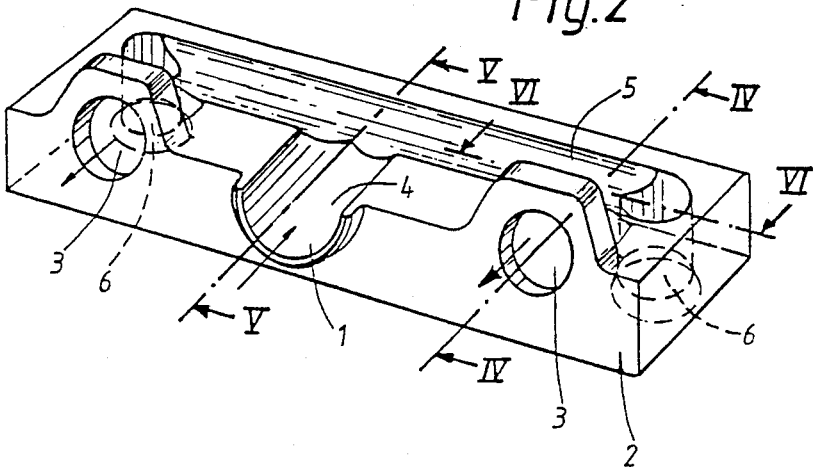
Figure 3:
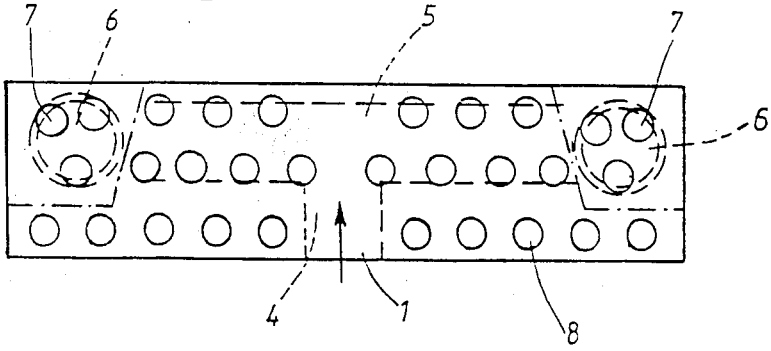
FIG. 3 shows a schematic top view of the heat exchanger equipped with an upper compartment according to FIGS. 1 and 2 with this schematic representation illustrating the run of the channels and pipes.

As shown in FIG. 2, the flow connection 1 allocated to the upper compartment 2 of the heat exchanger is centrally positioned at a longitudinally side (facing front in FIG. 2) of the upper compartment. The return connections 3, also positioned at the longitudinal side of the upper compartment, are located on both sides of the flow connection 1. The flow connection 1 merges via a junction channel 4 into a transverse channel 5. Channel 5 leads into connecting areas 6 which are located laterally outwards, that is, on the left and right ends of the heat exchanger. As shown in FIG. 3, flow pipes 7 are positioned only at the connecting areas 6.

Figure 4:
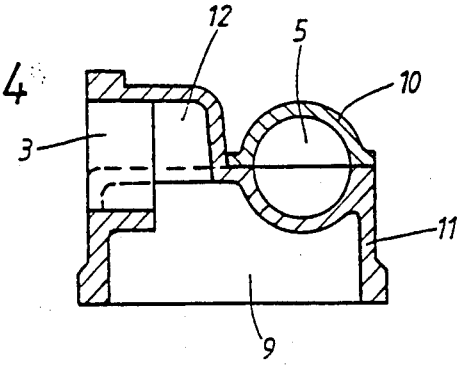
FIGS. 4 to 6 show sectional representations along lines IV—IV, V—V and VI—VI according to FIG. 2.
Figure 5:
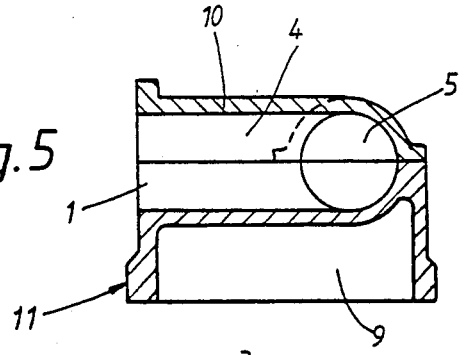
Figure 6:
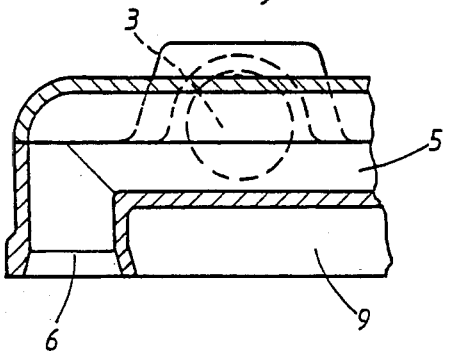
Figure 8:
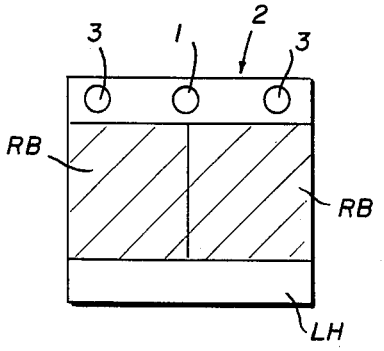
FIG. 8 schematically depicts a heat exchanger utilizing the heat exchanger compartment arrangement according to FIGS. 1, 2 and 7.

The medium, according to preferred embodiments water and air, flows via the flow pipes 7 of the ribbed pipe blocks (RB schematically depicted in FIG. 8) into the respective half of the lower water compartment (LH schematically depicted in FIG. 8) and here passes over into the return pipes 8 which open out into the collecting chamber 9. As shown in FIGS. 4–6, the collecting chamber 9 is positioned at the lower portion of the upper water compartment and is indicated in FIG. 3 only in its outline form. The collecting chamber 9 runs the entire length and width of the lower portion of the upper water compartment 2, excluding the connecting area 6. The collecting chamber 9, therefore, accommodates all the pipes of the ribbed pipe block, except those pipes directly in the connecting area 6. All pipes flowing into the collecting chamber are designated as return pipes 8. The medium flows from the collecting chamber 9 to the return connections 3, wherein the collecting chamber is subdivided into a right and left section of the heat exchanger corresponding to the laterally outward flow of the heating medium to the right and left ends of the heat exchanger as it enters the transverse channel 5.

Figure 1:
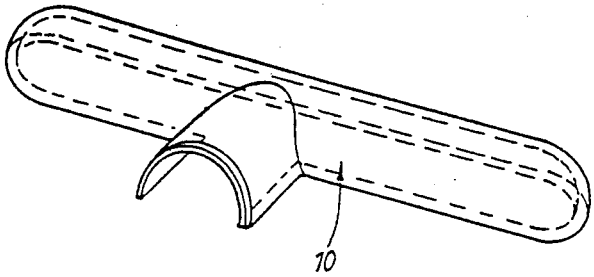
FIGS. 1 and 2 show a schematic enlarged representation of the upper water compartment of a heat exchanger according to the invention.

As can be seen from FIGS. 1 and 2, in conjunction with FIGS. 4 to 6, the upper water compartment 2 is subdivided into an upper and lower portion. When the flow and return connections 1 and 3 and the channels 4 and 5 are constructed in accordance with preferred embodiments of the invention, the dividing plane is positioned such that a double-shelled design results for the flow connection 1, the junction channel 4 and the transverse channel 5. The upper part, which in the illustrative embodiment is shown as an upper half shell, is designated as 10 in FIG. 1.

According to this preferred embodiment, the center plane of the return connections 3 also lies in the dividing plane of the double-shelled design. These return connections 3, however, are allocated as a whole to the lower part 11 of the upper compartment 2 into which is worked the lower shell half, as shown in FIG. 2. In this embodiment, the upper area of the return connections 3, together with the adjoining overflow channels 12 (FIG. 4), are made as hump-like extensions of the lower part 11 of the upper compartment 2. In this way, no subdivision is necessary in the connecting and overflow channel and thus separate seals are dispensed with.

Schematically depicted by dash lines D in FIG. 4 is an embodiment in which the upper water compartment 2 is fully subdivided by the dividing plane, resulting in a subdivision in the area of the return connections.

The two embodiments referred to above are characterized by a design which can be easily cast. Even when the water compartment is made from plastic, a simple molding of the channels may be made, even when manufactured by pressure diecasting.

Figure 7:
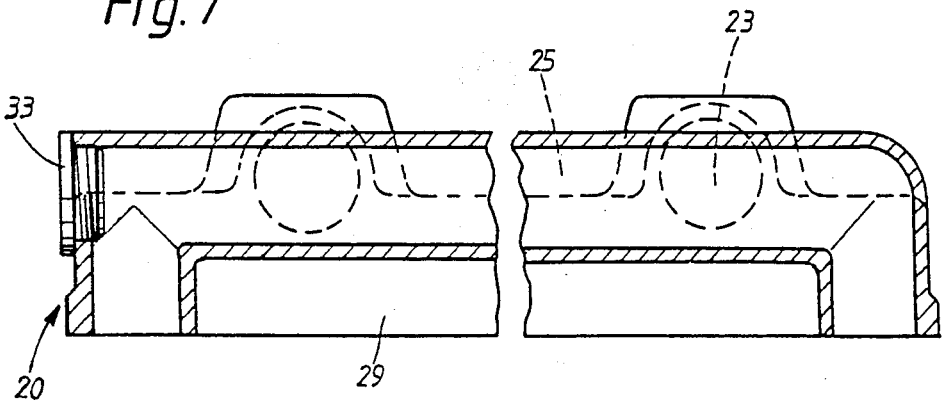
FIG. 7 shows a modified embodiment of the upper compartment of a heat exchanger according to FIG. 2 in sectional representation corresponding to the sectional direction for FIG. 6.

A preferred embodiment contemplated by the invention and shown in FIG. 7 eliminates the need for sealing limits, yet it can still be relatively inexpensively produced. In this embodiment, the upper compartment is designated as a whole as 20, and the return connections are designated as 23, the collecting chamber as 29 and the transverse channel as 25. The flow connection for this embodiment is not shown because the center area is not shown, however the transition between the transverse channel 25 and the flow connection not shown corresponds, apart from the division, to the transition shown in Figure 5.

In the representation according to FIG. 7, the transverse channel 25 is continuously open at one of its ends. The open end of the transverse channel 25 is closed by a plug 33 following the manufacture of the upper part 20.

According to preferred embodiments of the invention of the upper water compartment 2 or 20, a heat exchanger aligned to the central run of the flow pipes can be easily converted into a heat exchanger in which the flow is allocated to the outer ends of the heat exchanger. This conversion may be accomplished while retaining the basic construction of the ribbed pipe blocks of the heat exchanger.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An upper heat exchanger header for a heat exchanger for independent heating of the driver and front passenger side of a passenger space of a motor vehicle, said heat exchanger being of the type having a pair of ribbed block units, each including inlet flow pipes and return flow pipes extending therethrough between an upper heat exchanger header and a lower heat exchanger header, said upper heat exchanger header comprising:

centrally disposed inlet flow connection means for accommodating inflow of heating medium means, transverse channel means extending across a substantial portion of the lateral width of the upper heat exchanger header and being configured to connect the inlet flow connection means with respective inlet flow pipe openings opening into the respective lateral outward portions of the upper heat exchanger header, and return flow collection chamber means extending substantially across the width of the upper heat exchanger header and between the respective inlet flow openings for accommodating return flow from return flow pipes of the respective ribbed block units communicating therewith, whereby the inlet flow of the heating medium is passed from the upper heat exchanger header downwardly through the ribbed block units at positions laterally outwardly of the location of return flow pipes in the ribbed block unit thereby optimizing heat stratification in the heat exchanger.

2. An upper heat exchanger header according to claim 1, further comprising return flow connection means for communicating the return flow collection chamber means with a return flow circuit of a vehicle, said return flow connection means including respective return flow openings disposed at respective opposite lateral sides of the inlet flow connection means.

3. An upper heat exchanger header according to claim 2, wherein said return flow openings and said inlet flow connection means are disposed in a common first side wall of the upper heat exchanger header so as to accommodate respective in and out flow in directions transverse to said first side wall.

4. An upper heat exchanger header according to claim 1, wherein said transverse channel means is disposed above the return flow collection chamber means.

5. An upper heat exchanger header according to claim 3, wherein said transverse channel means is disposed above the return flow collection chamber means.

6. An upper heat exchanger header according to claim 5, wherein said transverse channel means extends along a second side wall of the upper heat exchanger header, which second side wall is parallel to and opposite said first side wall.

7. An upper heat exchanger header according to claim 1, wherein said header includes an opening to said transverse channel means through a lateral end wall of the header, and wherein plug means are provided to plug said opening, said opening and plug means serving to accommodate manufacture of the header.

8. An upper heat exchanger header according to claim 6, wherein said header includes an opening to said transverse channel means through a lateral end wall of the header, and wherein plug means are provided to plug said opening, said opening and plug means serving to accommodate manufacture of the header.

9. An upper heat exchanger header according to claim 1, wherein said header is formed by a plurality of shell means which are attached to one another.

10. An upper heat exchanger header according to claim 9, wherein said shell means includes an upper shell defining part of the transverse channel means and part of the inlet flow connection means.

11. An upper heat exchanger header according to claim 10, further comprising return flow connection means for communicating the return flow collection chamber means with a return flow circuit of a vehicle, said return flow connection means including respective return flow openings disposed at respective opposite lateral sides of the inlet flow connection means wherein said shell means includes a lower shell defining the return flow openings and part of both the transverse channel means and the inlet flow connection means.

12. An upper heat exchanger header according to claim 11, wherein said upper and lower shell abut one another at a center plane of the inlet flow connection means.

13. An upper heat exchanger header according to claim 12, wherein said return flow collection chamber means and return flow openings are formed in the lower shell.

14. A heat exchanger for independent heating of the driver and front passenger side of a passenger space of a motor vehicle, comprising:

an upper heat exchanger header, a lower heat exchanger header, and a pair of ribbed block units which each include inlet flow pipes and return flow pipes extending between the upper and lower headers, wherein said upper heat exchanger header comprises:

centrally disposed inlet flow connection means for accommodating inflow of heating medium means, transverse channel means extending across a substantial portion of the lateral width of the upper heat exchanger header and being configured to connect the inlet flow connection means with respective inlet flow pipe openings opening into the respective lateral outward portions of the upper heat exchanger header, and return flow collection chamber means extending substantially across the width of the upper heat exchanger header and between the respective inlet flow openings for accommodating return flow from return flow pipes of the respective ribbed block units communicating therewith, whereby the inlet flow of the heating medium is passed from the upper heat exchanger header downwardly through the ribbed block units at positions laterally outwardly of the location of return flow pipes in the ribbed block unit thereby optimizing heat stratification in the heat exchanger.

15. A heat exchanger according to claim 14, comprising return flow connection means for communicating the return flow collection chamber means with a return flow circuit of a vehicle, said return flow connection means including respective return flow openings disposed at respective opposite lateral sides of the inlet flow connection means.

16. A heat exchanger according to claim 15, wherein said return flow openings and said inlet flow connection means are disposed in a common first side wall of the upper heat exchanger header so as to accommodate respective in and out flow in directions transverse to said first side wall.

17. A heat exchanger according to claim 14, wherein said transverse channel means is disposed above the return flow collection chamber means.

18. A heat exchanger according to claim 16, wherein said transverse channel means is disposed above the return flow collection chamber means.

19. A heat exchanger according to claim 18, wherein said transverse channel means extends along a second side wall of the upper heat exchanger header, which second side wall is parallel to and opposite said first side wall.

20. A heat exchanger according to claim 14, wherein said upper header includes an opening to said transverse channel means channel means through a lateral end wall of the upper header, and wherein plug means are provided to plug said opening, said opening and plug means serving to accommodate manufacture of the upper header.

21. A heat exchanger according to claim 19, wherein said upper header includes an opening to said transverse channel means through a lateral end wall of the upper header, and wherein plug means are provided to plug said opening, said opening and plug means serving to accommodate manufacture of the upper header.

22. A heat exchanger according to claim 14, wherein said upper header is formed by a plurality of shell means, which are attached to one another.

23. A heat exchanger according to claim 22, wherein said shell means includes an upper shell defining part of the transverse channel means and part of the inlet flow connection means.

24. A heat exchanger according to claim 23, comprising return flow connection means for communicating the return flow collection chamber means with a return flow circuit of a vehicle, said return flow connection means including respective return flow openings disposed at respective opposite lateral sides of the inlet flow connection means wherein said shell means includes a lower shell defining the return flow openings and part of both the transverse channel means and the inlet flow connection means.

25. A heat exchanger according to claim 24, wherein said upper and lower shell abut one another at a center plane of the inlet flow connection means.

26. A heat exchanger according to claim 25, wherein said return flow collection chamber means and return flow openings are formed in the lower shell.

* * * * *